US010337306B2

(12) United States Patent
Batarseh

(10) Patent No.: US 10,337,306 B2
(45) Date of Patent: Jul. 2, 2019

(54) IN-SITU STEAM QUALITY ENHANCEMENT USING MICROWAVE WITH ENABLER CERAMICS FOR DOWNHOLE APPLICATIONS

(71) Applicant: Saudi Arabian Oil Company, Dhahran (SA)

(72) Inventor: Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 241 days.

(21) Appl. No.: 15/458,717

(22) Filed: Mar. 14, 2017

(65) Prior Publication Data

US 2018/0270920 A1 Sep. 20, 2018

(51) Int. Cl.

| | |
|---|---|
| ***E21B 43/24*** | (2006.01) |
| ***E21B 34/10*** | (2006.01) |
| ***F22B 3/00*** | (2006.01) |

(52) U.S. Cl.

CPC ..... *E21B 43/2406* (2013.01); *E21B 34/10* (2013.01); *E21B 43/24* (2013.01); *E21B 43/2401* (2013.01); *E21B 43/2408* (2013.01); *F22B 3/00* (2013.01)

(58) Field of Classification Search

CPC .. E21B 43/2401; E21B 43/2406; E21B 43/24; E21B 34/10; E21B 43/2408; H05B 6/804; F22B 3/00

See application file for complete search history.

(56) References Cited

U.S. PATENT DOCUMENTS

| | | | |
|---|---|---|---|
| 6,189,611 | B1 | 2/2001 | Kasevich |
| 8,936,090 | B2 | 1/2015 | Sultenfuss et al. |
| 9,027,638 | B2 | 5/2015 | Madison et al. |
| 9,267,358 | B2 | 2/2016 | Parsche |
| 2009/0008088 | A1 | 1/2009 | Schultz et al. |
| 2010/0200231 | A1 | 8/2010 | Minnich |
| 2012/0012319 | A1 | 1/2012 | Dennis |

(Continued)

FOREIGN PATENT DOCUMENTS

| | | | |
|---|---|---|---|
| WO | 2012038814 | A2 | 3/2012 |
| WO | 2013050075 | A1 | 4/2013 |

OTHER PUBLICATIONS

International Search Report and Written Opinion for International Application No. PCT/US2018/022159, dated Jul. 27, 2018 (pp. 1-12).

*Primary Examiner* — Michael R Wills, III

(74) *Attorney, Agent, or Firm* — Bracewell LLP; Constance G. Rhebergen; Linda L. Morgan

(57) ABSTRACT

A steam injector assembly for handling steam in a subterranean well includes a steam separation system, the steam separation system directing an initial high quality steam to a subterranean formation and directing low quality fluid mix to a heating system. The heating system includes a ceramic-containing member located in a travel path of the low quality fluid mix and an electromagnetic antenna positioned to heat the ceramic-containing member with electromagnetic waves. A relief valve is movable to an open position when an improved high quality steam within a heating chamber of the heating system reaches an injection pressure, wherein in the open position, the relief valve provides a fluid flow path out of the heating chamber.

21 Claims, 2 Drawing Sheets

(56) References Cited

U.S. PATENT DOCUMENTS

| | | | | |
|---|---|---|---|---|
| 2012/0118879 | A1* | 5/2012 | Rey-Bethbeder | E21B 43/2401 219/679 |
| 2013/0020078 | A1 | 1/2013 | Vasudevan | |
| 2013/0213637 | A1 | 8/2013 | Kearl | |
| 2015/0021008 | A1 | 1/2015 | Batarseh | |
| 2016/0069857 | A1 | 3/2016 | Batarseh et al. | |
| 2016/0326839 | A1 | 11/2016 | Ayub et al. | |

* cited by examiner

IN-SITU STEAM QUALITY ENHANCEMENT USING MICROWAVE WITH ENABLER CERAMICS FOR DOWNHOLE APPLICATIONS

BACKGROUND

Field of the Disclosure

Generally, this disclosure relates to enhanced oil recovery. More specifically, this disclosure relates to electromagnetic assisted ceramic materials for steam quality separation, enhancement, and injection.

Background of the Disclosure

Enhanced oil recovery relates to techniques to recover additional amounts of crude oil from reservoirs. Enhanced oil recovery focuses on recovery of reservoir heavy oil and aims to enhance flow from the formation to the wellbore for production. To produce heavy oil from the targeted formation, it is greatly beneficial to reduce the viscosity of the heavy oil in the formation. In many instances, heat is introduced to the formation to lower the viscosity and allow the oil to flow. Among the ways increased temperature can be introduced into a formation are steam injection, in-situ combustion, or electromagnetic heating including microwave.

Steam injection is a common thermal recovery method practice currently used worldwide. The injection of steam can reduce the heavy oil viscosity and increase hydrocarbon mobility, thus allowing the oil to be produced more efficiently. However, in some current systems, there is significant heat loss of the steam from the steam generator to the wellhead to the downhole injection location, reducing the quality of the steam that reaches the downhole location. As an example, the volume of high quality steam can be reduced from 75% to 55% after traveling 5000 feet. This will result in a lower quality and heavier steam with reduced overall heat delivery.

SUMMARY

Embodiments disclosed herein provide systems and methods for first separating low quality steam from high quality steam, injecting the high quality steam and combining ceramic material downhole with electromagnetic wave energy to heat up the ceramic material and convert the low quality steam to high quality steam for injection.

In an embodiment of this application, a steam injector assembly for handling steam in a subterranean well includes a steam separation system, the steam separation system directing an initial high quality steam to a subterranean formation and directing low quality fluid mix to a heating system. The heating system has a ceramic-containing member located in a travel path of the low quality fluid mix and an electromagnetic antenna positioned to heat the ceramic-containing member with electromagnetic waves. A relief valve is movable to an open position when an improved high quality steam within a heating chamber of the heating system reaches an injection pressure, wherein in the open position, the relief valve provides a fluid flow path out of the heating chamber.

In alternate embodiments the steam injector assembly can include an upper accumulation chamber with an upper valve, the upper valve moveable to an open position by a first accumulated weight of low quality fluid mix. The steam injector assembly can further include a lower accumulation chamber with a lower valve, the lower accumulation chamber being in fluid communication with the upper accumulation chamber when the upper valve is in the open position, the lower valve moveable to an open position by a second accumulated weight of low quality fluid mix, and wherein in the open position, the lower valve provides fluid communication between the lower accumulation chamber and the heating chamber.

In other alternate embodiments the ceramic-containing member can include at least one ceramic mesh plate located within an inner bore of the heating chamber and alternately the ceramic-containing member can include a ceramic bottom located at an end of the heating chamber. The relief valve can include perforations through a sidewall of the heating chamber. The heating chamber can be circumscribed by a perforated liner, the perforated liner providing fluid communication between the steam injector assembly and the subterranean formation. The steam separation system can include sloped pads directing the low quality fluid mix in a direction downward and providing a path for the initial high quality steam in an upward direction between successive sloped pads.

In an alternate embodiment of this disclosure, a system for injecting steam into a subterranean formation with a steam injector assembly includes at least one subterranean hydrocarbon production well extending to the subterranean formation. A subterranean steam injection well extends to the subterranean formation. The steam injector assembly is located within the subterranean steam injection well. The steam injector assembly has a steam separation system, the steam separation system directing an initial high quality steam to the subterranean formation and directing low quality fluid mix to a heating system. The heating system has a ceramic-containing member located in a travel path of the low quality fluid mix and an electromagnetic antenna positioned to heat the ceramic-containing member with electromagnetic waves. A relief valve is movable to an open position when an improved high quality steam within a heating chamber of the heating system reaches an injection pressure, wherein in the open position, the relief valve provides a fluid flow path out of the heating chamber.

In alternate embodiments the system can include a steam generator located at an earth's surface, the steam generator in fluid communication with a bore of the subterranean steam injection well. A power generation unit can generate power with a pump of one of the at least one subterranean hydrocarbon production wells, the power generation unit in electrical communication with the steam injector assembly. The electromagnetic waves can have a wavelength in a range of a microwave, a radio frequency wave, or in the range of the microwave to the radio frequency wave. The ceramic-containing member can include a series of ceramic mesh plates located within an inner bore of the heating chamber.

In another alternate embodiment of this disclosure, a method for injecting steam into a subterranean formation with a steam injector assembly includes locating a steam separation system of the steam injector assembly within a subterranean steam injection well, the steam separation system directing an initial high quality steam to the subterranean formation and directing a low quality fluid mix to a heating system of the steam injector assembly. The heating system has a ceramic-containing member located in a travel path of the low quality fluid mix. The ceramic-containing member is heated with electromagnetic waves of an electromagnetic antenna of the heating system, to generate an improved high quality steam from the low quality fluid mix. A relief valve of the steam injector assembly is provided that is movable to an open position when the improved high quality steam within a heating chamber of the heating system reaches an injection pressure, wherein in the open position, the relief valve provides a fluid flow path out of the heating chamber.

In alternate embodiments, the steam separation system can further include an upper accumulation chamber with an upper valve, the upper valve moveable to an open position by a first accumulated weight of low quality fluid mix, and a lower accumulation chamber with a lower valve, the lower accumulation chamber being in fluid communication with the upper accumulation chamber when the upper valve is in the open position. The lower valve can be moveable to an open position by a second accumulated weight of low quality fluid mix, and wherein in the open position, the lower valve provides fluid communication between the lower accumulation chamber and the heating chamber.

In other alternate embodiments the ceramic-containing member can include at least one ceramic mesh plate located within an inner bore of the heating chamber and a ceramic bottom located at an end of the heating chamber. The relief valve can include perforations through a sidewall of the heating chamber and the heating chamber is circumscribed by a perforated liner, so that the improved high quality steam that passes out of the heating chamber through the relief valve is injected into the subterranean formation through the perforated liner.

In yet other alternate embodiments, the steam separation system can include sloped pads directing the low quality fluid mix in a direction downward and providing a path for the initial high quality steam in an upward direction between successive sloped pads. The subterranean steam injection well can extend into the subterranean formation and the method can further include providing at least one subterranean hydrocarbon production well that extends into the subterranean formation. Power can be generated with a power generation unit driven by a pump of one of the at least one subterranean hydrocarbon production wells, the power generation unit providing electrical power to the steam injector assembly. Steam can be generated with a steam generator located at an earth's surface and injecting the steam into a bore of the subterranean steam injection well.

BRIEF DESCRIPTION OF THE DRAWINGS

So that the manner in which the above-recited features, aspects and advantages of the embodiments of this disclosure, as well as others that will become apparent, are attained and can be understood in detail, a more particular description of the disclosure briefly summarized above may be had by reference to the embodiments thereof that are illustrated in the drawings that form a part of this specification. It is to be noted, however, that the appended drawings illustrate only preferred embodiments of the disclosure and are, therefore, not to be considered limiting of the disclosure's scope, for the disclosure may admit to other equally effective embodiments.

DETAILED DESCRIPTION OF THE DISCLOSURE

Embodiments of the present disclosure will now be described more fully hereinafter with reference to the accompanying drawings which illustrate embodiments of the disclosure. Systems and methods of this disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments or positions.

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the skills of persons skilled in the relevant art.

Figure 1:
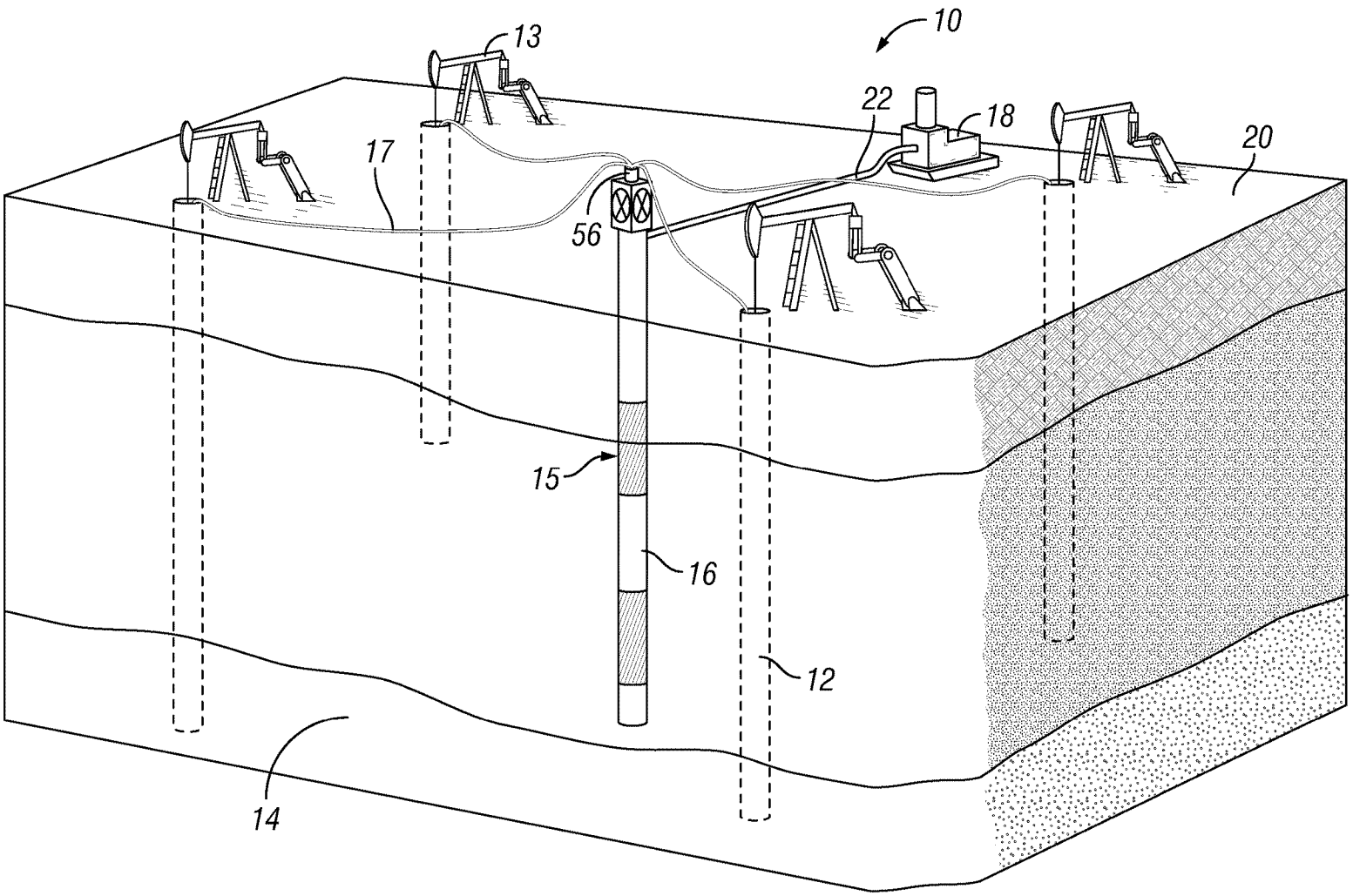
FIG. 1 is general schematic perspective view of a hydrocarbon development system using a steam injector assembly in accordance with an embodiment of this disclosure.

Looking at FIG. 1, example hydrocarbon development 10 includes a common five spot steam injection pattern that has four hydrocarbon production wells 12 extending to subterranean formation 14. In alternate embodiments there may be as few as one hydrocarbon production well 12 or more than four hydrocarbon production wells 12. Each hydrocarbon production well 12 can have an artificial lift assembly 13 such as a pumpjack, electrical submersible pump, or other known hydrocarbon lift device. Artificial lift assembly 13 can be used to generate electric energy to power pumps at other hydrocarbon production wells 12 and can be in electrical communication with steam injector assembly 15 by way of cables 17 for providing electrical power to steam injector assembly 15. As an example, artificial lift assembly 13 of one of the hydrocarbon production wells 12 could generate up to 5 kW per day of electricity from their motion or other pump generated energy. In certain embodiments, only one of the artificial lift assemblies 13 generates electricity. In alternate examples, two or more of the artificial lift assemblies 13 can generate electricity.

Hydrocarbon development 10 also includes subterranean steam injection well 16 extending to subterranean formation 14. In the example of FIG. 1, the four hydrocarbon production wells 12 are spaced around subterranean steam injection well 16 and located a within a distance from subterranean steam injection well 16 that steam injected into subterranean formation 14 from subterranean steam injection well 16 would improve production at each of the hydrocarbon production wells 12. As an example, steam injected into subterranean steam injection well 16 can boost production at each hydrocarbon production well through mechanical displacement of the hydrocarbons by the steam, a reduction in the viscosity of the crude oil, swelling of the crude oil, and distillation of the crude oil in the steam zone.

Steam generator 18 located at an earth's surface 20 generates steam for injection into a bore of subterranean steam injection well 16. Steam delivery pipe 22 delivers steam from steam generator 18 to the top end of subterranean steam injection well 16, providing fluid communication between steam generator 18 and the bore of subterranean steam injection well 16.

Steam injector assembly 15 is associated with subterranean steam injection well 16. Looking at FIG. 2, steam injector assembly 15 includes steam separation system 24. Steam separation system 24 is located within well tubular 25 that is part of the string of tubular members that make up the string of tubular members defining subterranean steam injection well 16. The injected steam can reach steam separation system with a mix of initial high quality steam 26 and a low quality fluid mix 28. Low quality fluid mix 28 can include both a dense steam and a liquid such as water. Steam separation system 24 can separate initial high quality steam 26 from low quality fluid mix 28. Steam separation system 24 directs initial high quality steam 26 towards subterranean formation 14 and directs low quality fluid mix 28 towards heating system 30.

Figure 2:
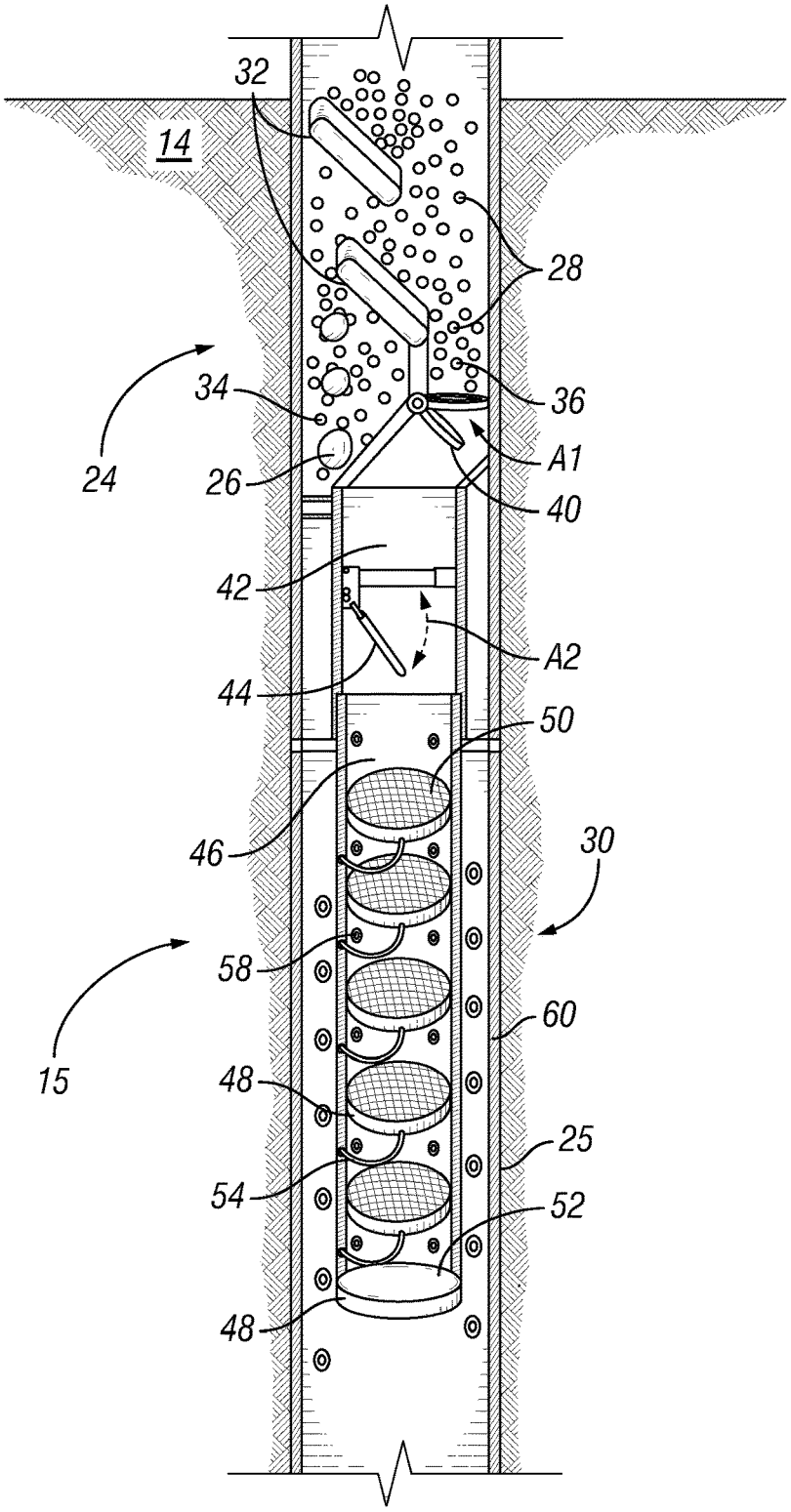
FIG. 2 is a section view of a steam injector assembly in accordance with an embodiment of this disclosure.

In the example embodiment of FIG. 2, sloped pads 32 can be used to mix and distribute the flow of steam and to separate initial high quality steam 26 from low quality fluid mix 28. In order to direct initial high quality steam 26 towards subterranean formation 14, steam separation system 24 includes sloped pads 32. Sloped pads 32 are located within the inner bore of well tubular 25. As a lighter component of the steam injected into subterranean steam injection well 16, initial high quality steam 26 can travel in a generally upward direction between successive sloped pads 32. Due to the continuous injection of steam into subterranean steam injection well 16, initial high quality steam 26 can then be forced to pass directly into subterranean formation 14 after passing between sloped pads 32. Openings 34 through an outer wall of well tubular 25 of steam injector assembly 15 can allow for initial high quality steam 26 to pass out of steam injector assembly 15 and into subterranean formation 14. Openings 34 can have, for example, one way valves to allow the initial high quality steam 26 to exit out of injector assembly 15 without allowing fluids of the subterranean formation 14 to enter injector assembly 15.

When entering steam separation system 24, low quality fluid mix 28 will be a heavier component of the injected steam and gravity will tend to draw low quality fluid mix 28 downward. Low quality fluid mix 28 that lands on sloped pads 32 can roll off sloped pads 32 with sloped pads 32 further directing low quality fluid mix 28 in a downward direction.

Low quality fluid mix 28 that has passed sloped pads 32 will accumulate in upper accumulation chamber 36 of steam separation system 24. Upper accumulation chamber 36 has upper valve 40 located at a bottom end of upper accumulation chamber 36. Upper valve 40 is moveable to an open position (as shown by arrow A1 of FIG. 2) when the weight of the low quality fluid mix 28 gathered in upper accumulation chamber 36 reaches a first accumulated weight. Upper valve 40 is shown in the open position in FIG. 2.

When upper valve 40 moves to an open position lower accumulation chamber 42 is in fluid communication with upper accumulation chamber 36 and low quality fluid mix 28 can move to lower accumulation chamber 42. Low quality fluid mix 28 will accumulate in lower accumulation chamber 42. Lower accumulation chamber 42 has lower valve 44. Lower valve 44 is a one way valve that is moveable to an open position (as shown by arrow A2 of FIG. 2) when the weight of the low quality fluid mix 28 gathered in lower accumulation chamber 42 reaches a second accumulated weight. Lower valve 44 is shown in the open position in FIG. 2.

When lower valve 44 moves to an open position lower accumulation chamber 42 is in fluid communication with heating chamber 46 and low quality fluid mix 28 can move to heating chamber 46 of heating system 30. Heating chamber 46 is a generally cylindrical member located within a bore of well tubular 25.

Heating system 30 includes ceramic-containing member 48 located in a travel path of low quality fluid mix 28 as low quality fluid mix 28 travels through heating chamber 46. In the example embodiment of FIG. 2, ceramic-containing member 48 includes a series of ceramic mesh plates 50 located within an inner bore of heating chamber 46. In alternate embodiments, there can be one ceramic mesh plate 50 located within the inner bore of heating chamber 46. Ceramic mesh plate 50 can be formed of a porous and permeable ceramic mesh through which the low quality fluid mix 28 can flow. Ceramic-containing member 48 can also include ceramic bottom plate 52 located at an end of heating chamber 46.

Heating system 30 further includes electromagnetic antenna 54 positioned to heat ceramic-containing member 48 with electromagnetic waves. Ceramic-containing member 48 is sufficiently heated by the electromagnetic waves to generate improved high quality steam from the low quality fluid mix 28. Each ceramic-containing member 48 can be associated with a separate discreet electromagnetic antenna 54. Alternately, an electromagnetic antenna 54 can generate electromagnetic waves for heating more than one ceramic-containing member 48.

The electromagnetic waves produced by electromagnetic antenna 54 can have a wavelength in a range of a microwave, a radio frequency wave, or in the range of a microwave to radio frequency wave. For example, electromagnetic antenna 54 can produce an electromagnetic wave having a wavelength in the range of 3 MHz to 300 MHz, in the range of 300 MHz to 300 GHz, or in the range of 3 MHz to 300 GHz. Looking at FIG. 1, electromagnetic wave generator 56 for generating the waves produced by electromagnetic antenna 54 can be located on the top of subterranean steam injection well 16. In alternate embodiments, other known means of generating suitable electromagnetic waves for production by electromagnetic antenna 54 downhole can be used. Electromagnetic antenna 54 can be a custom directional antenna that can focus the beam in a particular direction, such as towards a desired target. Such a custom directional antenna can provide an efficient means for directing electromagnetic waves towards ceramic containing member 48 without wasting energy. In alternate embodiments, a currently available industrial downhole electromagnetic antenna 54 can be used that provides a less focused beam. Electromagnetic wave generator 56 can be powered by energy derived from artificial lift assembly 13.

The ceramic materials used in ceramic-containing member 48 can have unique characteristics that allow ceramic-containing member 48 to heat up when exposed to the electromagnetic waves. In certain embodiments, ceramic-containing member 48 can be heated to at least about 1000° C. when exposed to electromagnetic waves from electromagnetic antenna 54. In certain embodiments, the ceramic materials heat within minutes, such as less than about 5 minutes. In alternate embodiments, the ceramic materials heat in less than about 3 minutes.

Earth ceramic materials have been identified and successfully evaluated and tested for potential usage due to their unique characteristics in heating up rapidly reaching 1000° C. when exposed to electromagnetic waves. Such materials also can have flexibility to be molded and formed in any shape and size needed. In addition, such materials can be very durable and be beneficial for a number of years of use.

In certain embodiments, the ceramic materials include ceramic materials obtained from Advanced Ceramic Technologies, such the CAPS, B-CAPS, C-CAS AND D-CAPS products. These products are generally natural clays that include silica, alumina, magnesium oxide, potassium, iron III oxide, calcium oxide, sodium oxide, and titanium oxide.

Looking at FIG. 2, low quality fluid mix 28 will pass through uppermost ceramic mesh plate 50, converting an amount of the low quality fluid mix 28 into improved high quality steam. A remaining amount of low quality fluid mix 28 passes through subsequent ceramic mesh plates 50 converting such remaining amount of low quality fluid mix 28 into improved high quality steam. Any low quality fluid mix 28 that passes through all of the ceramic mesh plates 50 without being converted to improved high quality steam will land on ceramic bottom plate 52. The heat of ceramic bottom plate 52 will cause any low quality fluid mix 28 that passes through all of the ceramic mesh plates 50 to be converted to improved high quality steam.

Heating system 30 further includes relief valve 58. Relief valve 58 can move to an open position when the improved high quality steam reaches an injection pressure. Injection pressure of relief valve 58 is set based on desired steam injection pressure, which is determined by reservoir studies. In the open position, relief valve 58 provides a fluid flow path out of the heating chamber 46. In the example of FIG. 2, relief valve 58 includes perforations through a sidewall of heating chamber 46 with each perforation having a one way valve member.

Heating chamber 46 is circumscribed by perforated liner 60 that is part of well tubular 25. Perforated liner 60 provides fluid communication between steam injector assembly 15 and subterranean formation 14. Improved high quality steam that passes out of heating chamber 46 through the relief valve 58 enters the annular space between an outer surface of heating chamber 46 and an inner surface of perforated liner 60. Improved high quality steam that passes out of heating chamber 46 through the relief valve 58 is injected into subterranean formation 14 through perforated liner 60.

Embodiments of this disclosure therefore provide enhanced hydrocarbon flow and communications between the formations to the wellbore for production. Systems and methods disclosed in this application have particular use in heavy oil and tar sand developments and for wellbore stimulation clean up, including for condensate removal. For example, heavy oil can be defined as oil having an API gravity of less than 29 or less than 22 and having a viscosity more than 5000 cP. In such developments, viscosity reduction is the key for improving the flow of hydrocarbons.

Embodiments of this disclosure provide systems and methods for steam injection that can be used with current or new steam injection operations, can segregate low from high quality steam, can converts low steam quality into high steam quality, and can utilizes pump generated energy, or motion energy from the pump to electricity to power up the electromagnetic wave generator.

Although the present disclosure has been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a," "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

As used herein and in the appended claims, the words "comprise," "has," and "include" and all grammatical variations thereof are each intended to have an open, non-limiting meaning that does not exclude additional elements or steps.

What is claimed is:

1. A steam injector assembly for handling steam in a subterranean well, the steam injector assembly having:

a steam separation system, the steam separation system directing an initial high quality steam to a subterranean formation and directing low quality fluid mix to a heating system, the heating system having:

a ceramic-containing member located in a travel path of the low quality fluid mix; and an electromagnetic antenna positioned to heat the ceramic-containing member with electromagnetic waves; and a relief valve movable to an open position when an improved high quality steam generated from the low quality fluid mix within a heating chamber of the heating system reaches an injection pressure, wherein in the open position, the relief valve provides a fluid flow path out of the heating chamber.

2. The steam injector assembly of claim 1, further including an upper accumulation chamber with an upper valve, the upper valve moveable to an open position by a first accumulated weight of low quality fluid mix.

3. The steam injector assembly of claim 2, further including a lower accumulation chamber with a lower valve, the lower accumulation chamber being in fluid communication with the upper accumulation chamber when the upper valve is in the open position, the lower valve moveable to an open position by a second accumulated weight of low quality fluid mix, and wherein in the open position, the lower valve provides fluid communication between the lower accumulation chamber and the heating chamber.

4. The steam injector assembly of claim 1, wherein the ceramic-containing member includes at least one ceramic mesh plate located within an inner bore of the heating chamber.

5. The steam injector assembly of claim 1, wherein the ceramic-containing member includes a ceramic bottom located at an end of the heating chamber.

6. The steam injector assembly of claim 1, wherein the relief valve includes perforations through a sidewall of the heating chamber.

7. The steam injector assembly of claim 1, wherein the heating chamber is circumscribed by a perforated liner, the perforated liner providing fluid communication between the steam injector assembly and the subterranean formation.

8. The steam injector assembly of claim 1, wherein the steam separation system includes sloped pads directing the low quality fluid mix in a direction downward and providing a path for the initial high quality steam in an upward direction between successive sloped pads.

9. A system for injecting steam into a subterranean formation with a steam injector assembly, the system comprising:

at least one subterranean hydrocarbon production well extending to the subterranean formation;

a subterranean steam injection well extending to the subterranean formation; and the steam injector assembly located within the subterranean steam injection well, the steam injector assembly having:

a steam separation system, the steam separation system directing an initial high quality steam to the subterranean formation and directing low quality fluid mix to a heating system, the heating system having:

a ceramic-containing member located in a travel path of the low quality fluid mix; and an electromagnetic antenna positioned to heat the ceramic-containing member with electromagnetic waves; and a relief valve movable to an open position when an improved high quality steam generated from the low quality fluid mix within a heating chamber of the heating system reaches an injection pressure, wherein in the open position, the relief valve provides a fluid flow path out of the heating chamber.

10. The system of claim 9, further including a steam generator located at an earth's surface, the steam generator in fluid communication with a bore of the subterranean steam injection well.

11. The system of claim 9, further including a power generation unit generating power with a pump of one of the at least one subterranean hydrocarbon production wells, the power generation unit in electrical communication with the steam injector assembly.

12. The system of claim 9, wherein the electromagnetic waves have a wavelength in a range selected from the group consisting of 3 MHz to 300 MHz, 300 MHz to 300 GHz, and 3 MHz to 300 GHz.

13. The system of claim 9, wherein the ceramic-containing member includes a series of ceramic mesh plates located within an inner bore of the heating chamber.

14. A method for injecting steam into a subterranean formation with a steam injector assembly, the method comprising:

locating a steam separation system of the steam injector assembly within a subterranean steam injection well, the steam separation system directing an initial high quality steam to the subterranean formation and directing a low quality fluid mix to a heating system of the steam injector assembly, the heating system having a ceramic-containing member located in a travel path of the low quality fluid mix;

heating the ceramic-containing member with electromagnetic waves of an electromagnetic antenna of the heating system, to generate an improved high quality steam from the low quality fluid mix;

providing a relief valve of the steam injector assembly that is movable to an open position when the improved high quality steam within a heating chamber of the heating system reaches an injection pressure, wherein in the open position, the relief valve provides a fluid flow path out of the heating chamber.

15. The method of claim 14, wherein the steam separation system further includes an upper accumulation chamber with an upper valve, the upper valve moveable to an open position by a first accumulated weight of low quality fluid mix; and a lower accumulation chamber with a lower valve, the lower accumulation chamber being in fluid communication with the upper accumulation chamber when the upper valve is in the open position, the lower valve moveable to an open position by a second accumulated weight of low quality fluid mix, and wherein in the open position, the lower valve provides fluid communication between the lower accumulation chamber and the heating chamber.

16. The method of claim 14, wherein the ceramic-containing member includes at least one ceramic mesh plate located within an inner bore of the heating chamber and a ceramic bottom located at an end of the heating chamber.

17. The method of claim 14, wherein the relief valve includes perforations through a sidewall of the heating chamber and the heating chamber is circumscribed by a perforated liner, so that the improved high quality steam that passes out of the heating chamber through the relief valve is injected into the subterranean formation through the perforated liner.

18. The method of claim 14, wherein the steam separation system includes sloped pads directing the low quality fluid mix in a direction downward and providing a path for the initial high quality steam in an upward direction between successive sloped pads.

19. The method of claim 14, wherein the subterranean steam injection well extends into the subterranean formation and the method further includes providing at least one subterranean hydrocarbon production well that extends into the subterranean formation.

20. The method of claim 19, further including generating power with a power generation unit driven by a pump of one of the at least one subterranean hydrocarbon production wells, the power generation unit providing electrical power to the steam injector assembly.

21. The method of claim 14, further including generating steam with a steam generator located at an earth's surface and injecting the steam into a bore of the subterranean steam injection well.

* * * * *